US005454423A

United States Patent [19]

Tsuchida et al.

[11] Patent Number: 5,454,423

[45] Date of Patent: Oct. 3, 1995

[54] MELT PUMPING APPARATUS AND CASTING APPARATUS

[75] Inventors: Jiro Tsuchida, Hyogo; Hirotaka Tsubota; Hiroshi Yamaguchi, both of Osaka, all of Japan; Donnie D. Rhum, Bedford, Ind.

[73] Assignees: Kubota Corporation, Osaka, Japan; General Motors Corporation, Detroit, Mich.

[21] Appl. No.: 86,182

[22] Filed: Jun. 30, 1993

[51] Int. Cl.[6] ..... B22D 17/30; B22D 37/00

[52] U.S. Cl. ..... 164/337; 164/312; 222/596; 266/239

[58] Field of Search ..... 164/337, 133, 164/312; 222/594, 596; 266/239

[56] References Cited

U.S. PATENT DOCUMENTS

| | | | |
|---|---|---|---|
| 1,843,776 | 2/1932 | Lund | 222/596 X |
| 2,485,526 | 10/1949 | Bennett | 222/596 X |
| 3,700,025 | 10/1972 | Tenner | 164/337 X |
| 3,800,986 | 4/1974 | Stamp | 222/596 X |
| 3,876,191 | 4/1975 | Lauersdorf | 266/239 |
| 4,991,641 | 2/1991 | Kidd et al. | 164/133 X |
| 5,092,499 | 3/1992 | Sodderland | 222/596 |
| 5,125,450 | 6/1992 | Kidd et al. | 164/133 X |
| 5,181,551 | 1/1993 | Kidd et al. | 164/337 X |
| 5,244,033 | 9/1993 | Ueno | 164/337 X |

*Primary Examiner*—J. Reed Batten, Jr.
*Attorney, Agent, or Firm*—Edward J. Timmer

[57] ABSTRACT

Apparatus for supplying melt from a melt-holding vessel to a casting machine comprises a ceramic melt pump casing or housing submersible in the melt. The casing includes a melt-pumping chamber with a melt inlet and melt outlet and a piston-receiving bore communicated to the chamber. A piston having a ceramic pumping portion is movable in the bore relative to the chamber in a suction stroke to draw the melt into the chamber through the melt inlet and in a pumping stroke to discharge the melt from the chamber through the melt outlet to, for example, a melt casting machine. A melt inlet valve having a ceramic valve portion submersible in the melt is movable relative to the melt inlet to open/close the melt inlet when the piston pumping portion is moved in the respective suction/pumping stroke. A melt outlet valve having a ceramic valve portion submersible in the melt is movable relative to the melt outlet to close/open the melt outlet when the piston pumping portion is moved in the respective suction/pumping stroke. The casing, piston pumping portion, and melt inlet and outlet valve portions are supported from the support member so as to be submerged in the melt of the melt-holding vessel. Actuators provided for the piston and melt inlet and outlet valves are mounted on the support member above the melt.

17 Claims, 4 Drawing Sheets

MELT PUMPING APPARATUS AND CASTING APPARATUS

FIELD OF THE INVENTION

The present invention relates to melt pumping apparatus especially useful for supplying a metallic melt to a casting machine, such as a die casting machine, a casting mold, and the like.

BACKGROUND OF THE INVENTION

Die casting machines and processes are well known and in widespread use in the high volume manufacture of metal or alloy components. In general, a die casting machine comprises a fixed die member and a movable die member which define therebetween a die cavity in which an individual charge of molten metal is introduced and solidified to form a die casting. A vertically or horizontally oriented shot sleeve is connected to the fixed die member and includes an opening through which the charge of the molten metal to be cast is introduced ahead of a plunger disposed in the shot sleeve. When the molten metal charge is introduced into the shot sleeve, the plunger is advanced in the shot sleeve toward the die members in a manner to introduce the charge into the die cavity through a runner or gate communicating the die cavity and shot sleeve. After the metal solidifies in the die cavity, the movable die member is separated from the fixed die member to allow ejection of the die casting. The die members then are closed and another individual molten metal charge is introduced into the die cavity to make another die casting. This cycle is repeated to make additional die castings in high volume.

In a typical high volume die casting operation, the successive charges of molten metal are supplied to the shot sleeve from a heated melt transport ladle that receives an appropriate amount (charge) of molten metal from a melting furnace and then is moved to the shot sleeve where the molten metal charge is poured into the shot sleeve for introduction into the die cavity by movement of the plunger as described hereabove.

Use of the melt transport ladle for introducing successive molten metal charges to the shot sleeve is time consuming and requires continual movement of the melt supply ladle between the melting furnace and the shot sleeve of the die casting machine in order to maintain production. Moreover, the temperature of the molten metal charge can drop considerably during transport from the furnace to the shot sleeve. As a result, the melt temperature in the melting furnace is maintained higher than would otherwise be required. Higher melt temperature will aggravate thermal shock to the shot sleeve, plunger, and die members when the molten charge is supplied thereto.

Furthermore, during ladle transport from the melting furnace to the shot sleeve, the molten metal is exposed to ambient air and foreign matter in the air. As a result, the levels of oxide and other inclusions, dross, and sludge in the melt in the ladle can be increased and adversely affect the quality of the die casting produced therefrom.

It is an object of the invention to provide improved melt pumping apparatus having a pump casing or housing, a piston, and melt inlet/outlet flow control valves submersible in the melt in a melt-holding vessel and useful for supplying a controlled amount of melt from the vessel to a melt casting machine, whereby the aforementioned disadvantageous associated with use of the aforementioned melt transport ladle that continually moves between the melting furnace and the metal casting machine are eliminated.

It is another object of the invention to provide improved melt pumping apparatus having pump components comprising melt-resistant ceramic material submersible in a melt-holding vessel and operable over long time periods to supply a controlled amount of melt to a melt casting machine.

It is still another object of the invention to provide melt casting apparatus wherein a controlled amount of melt is pumped directly from a melt-holding vessel to a melt casting machine by a melt pumping apparatus via a melt supply conduit.

SUMMARY OF THE INVENTION

The present invention provides melt pumping apparatus useful for supplying melt, such as molten metal or alloy, from a melt-holding vessel, such as a melting furnace, to a casting machine wherein the apparatus comprises pump casing means having a melt pumping chamber submersible in the melt and including a melt inlet and melt outlet communicated to the chamber. Piston means is disposed in a casing bore that communicates to the pumping chamber. The piston means includes a piston pumping portion movable relative to the pumping chamber in a suction stroke to draw the melt into the chamber through the melt inlet and in a pumping stroke to discharge the melt from the chamber through the melt outlet. The apparatus includes melt inlet valve means having a valve portion submersible in the melt and movable relative to the melt inlet to open/close the melt inlet when the piston pumping portion is moved in the respective suction/pumping stroke. Melt outlet valve means is provided and includes a valve portion submersible in the melt and movable relative to the melt outlet to close/open said melt outlet when the piston pumping portion is moved in the respective suction/pumping stroke.

In one embodiment of the invention, the melt pumping apparatus includes support means adapted to be disposed on a melt-holding vessel. The casing means, piston means, and melt inlet and outlet valve means are supported on the support means in a manner that the pumping chamber, piston pumping portion, and melt inlet and outlet valve portions are submerged in the melt in the melt-holding vessel. Submerged portions of the casing means, piston means, and melt inlet and outlet valve means comprise the same or different ceramic material that is resistant to attack by the melt.

In another embodiment of the invention, fluid or other actuator means for moving the piston means and the melt inlet valve means are supported on the support means above the melt.

In still another embodiment of the invention, the pump casing means comprises a melt inlet casing having the pumping chamber therein and a casing sleeve fastened on the melt inlet casing to define the piston-receiving bore. The casing sleeve is supported beneath the support means so as to position the melt inlet casing submerged in the melt. The casing means further comprises a melt outlet casing having a melt discharge passage communicated to the pumping chamber via the melt outlet thereof and a casing sleeve fastened on the melt outlet casing and supported beneath the support means so as to position the outlet casing submerged in the melt.

The present invention also provides a melt casting apparatus wherein a melt casting machine is supplied with a controlled amount of melt from a melt-holding vessel by melt pumping apparatus through a supply conduit extending between the melt pumping apparatus and the melt casting machine.

The aforementioned objects and advantages of the invention will become more readily apparent from the following detailed description taken with the following drawings.

DETAILED DESCRIPTION

Figure 1:
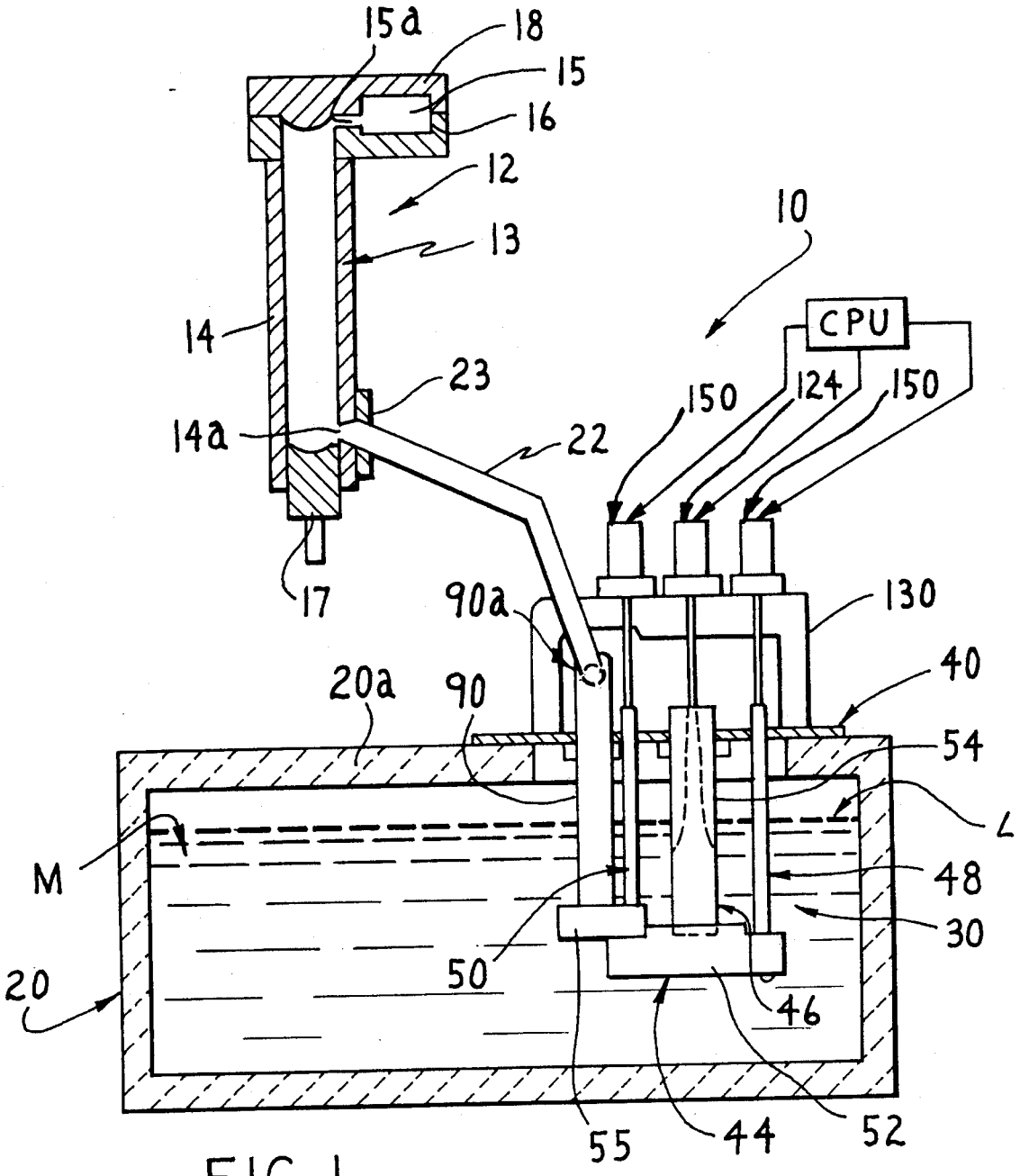
FIG. 1 is a highly schematic view of melt casting apparatus in accordance with one embodiment of the invention wherein controlled amounts of melt are supplied to a melt casting machine by melt pumping apparatus shown in detail FIGS. 2–4.

Referring to FIG. 1, a melt casting apparatus 10 in accordance with one embodiment of the invention is schematically illustrated. The melt casting apparatus 10 includes a melt casting machine 12 shown as die casting machine 13 having a shot sleeve 14 communicated by a runner 15*a* to a die cavity 15 defined between fixed and movable die members 16, 18 for die casting successive individual melt (e.g. molten aluminum) charges. The shot sleeve 14 can be oriented vertically as shown, horizontally, or at other orientations. The die casting machine 13 is supplied with controlled amounts of melt (e.g. molten aluminum) M from a conventional heated melting furnace vessel (or other melt-holding vessel) 20 by melt pumping apparatus 30 in accordance with the invention. The melt M is supplied from the furnace vessel 20 to the die casting machine 13 by the melt pumping apparatus 30 via a supply conduit 22 extending therebetween. The supply conduit 22 comprises a melt-resistant ceramic-lined or ceramic-coated pipe communicated to the melt inlet port 14*a* of the shot sleeve 14 and to a melt discharge port of the melt pumping apparatus 30. The conduit 22 can be connected to the shot sleeve 14 by a suitable coupling 23 as shown in FIG. 1. A plunger 17 is advanced in the shot sleeve 14 in conventional manner to force each successive charge of the melt M introduced in the shot sleeve 14 into the die cavity 15 formed between the die members 16, 18.

Although a die casting machine 13 is shown in FIG. 1 as the melt casting machine for purposes of illustration, the present invention is not so limited and can be practiced using other melt casting machines or equipment, such as a casting mold.

Furthermore, although the melt pumping apparatus 30 of the invention is shown for use in supplying the melt M to a melt casting machine 12, the apparatus 30 can be used in other ways as well, such as to supply or convey the melt M from one melt-holding vessel to another in a melt processing or melt-using operation.

Moreover, although the melt pumping apparatus of the present invention is especially useful in pumping highly corrosive metal and metal alloy melts to a casting machine, it can be used to pump other fluid or fluid-like melts.

Figure 2:
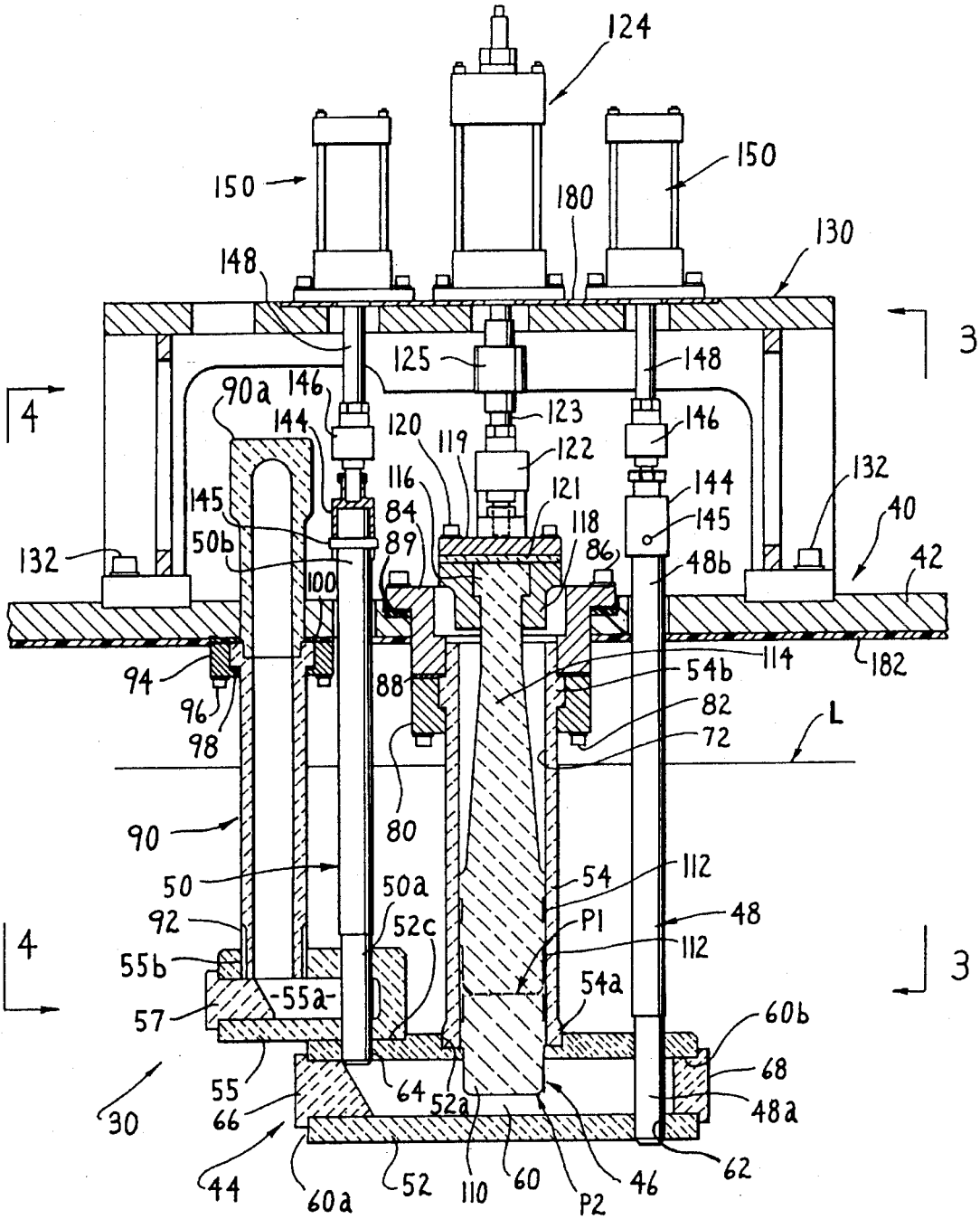
FIG. 2 is sectioned, side view of melt pumping apparatus in accordance with one embodiment of the invention.
Figure 3:
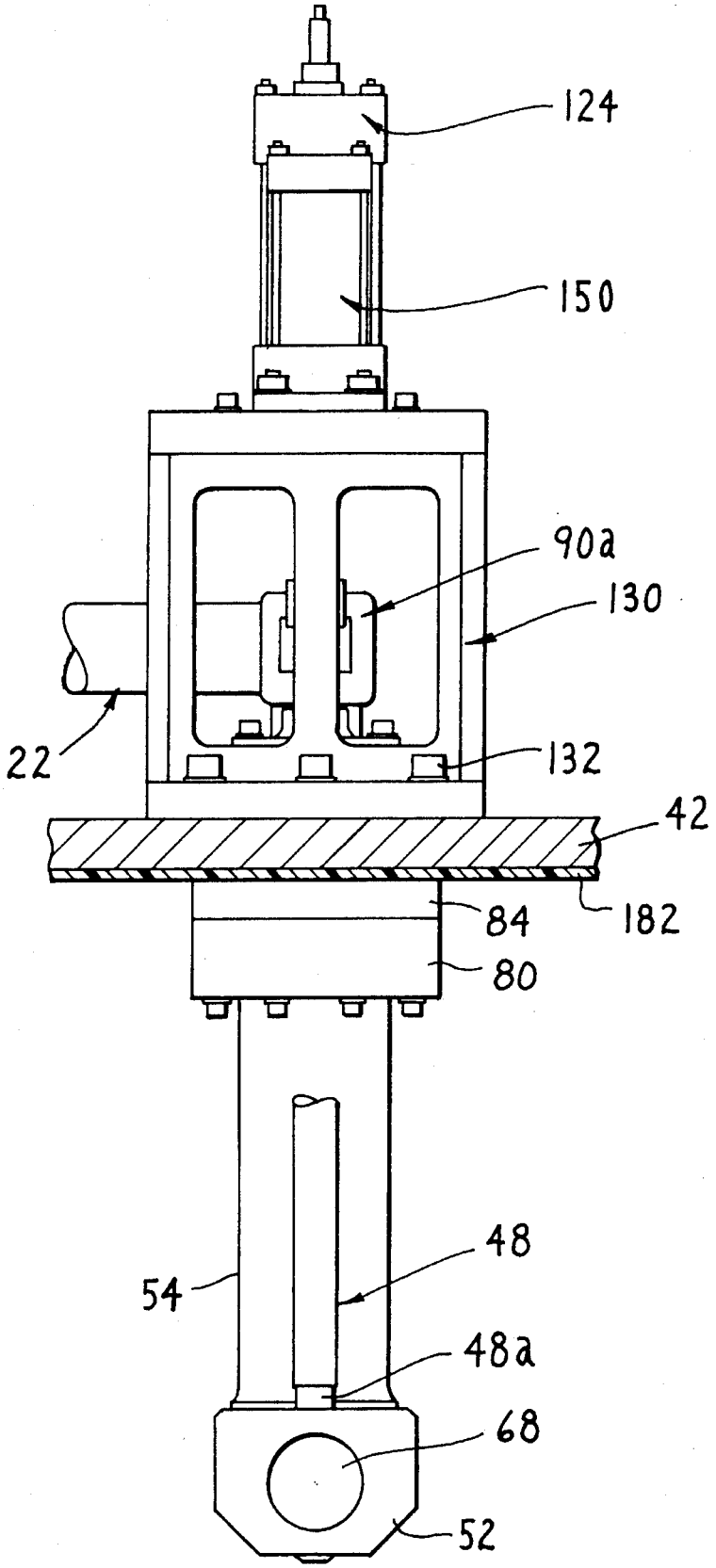
FIG. 3 is a side view of the melt pumping apparatus of FIG. 2 taken in the direction of arrows 3—3.
Figure 4:
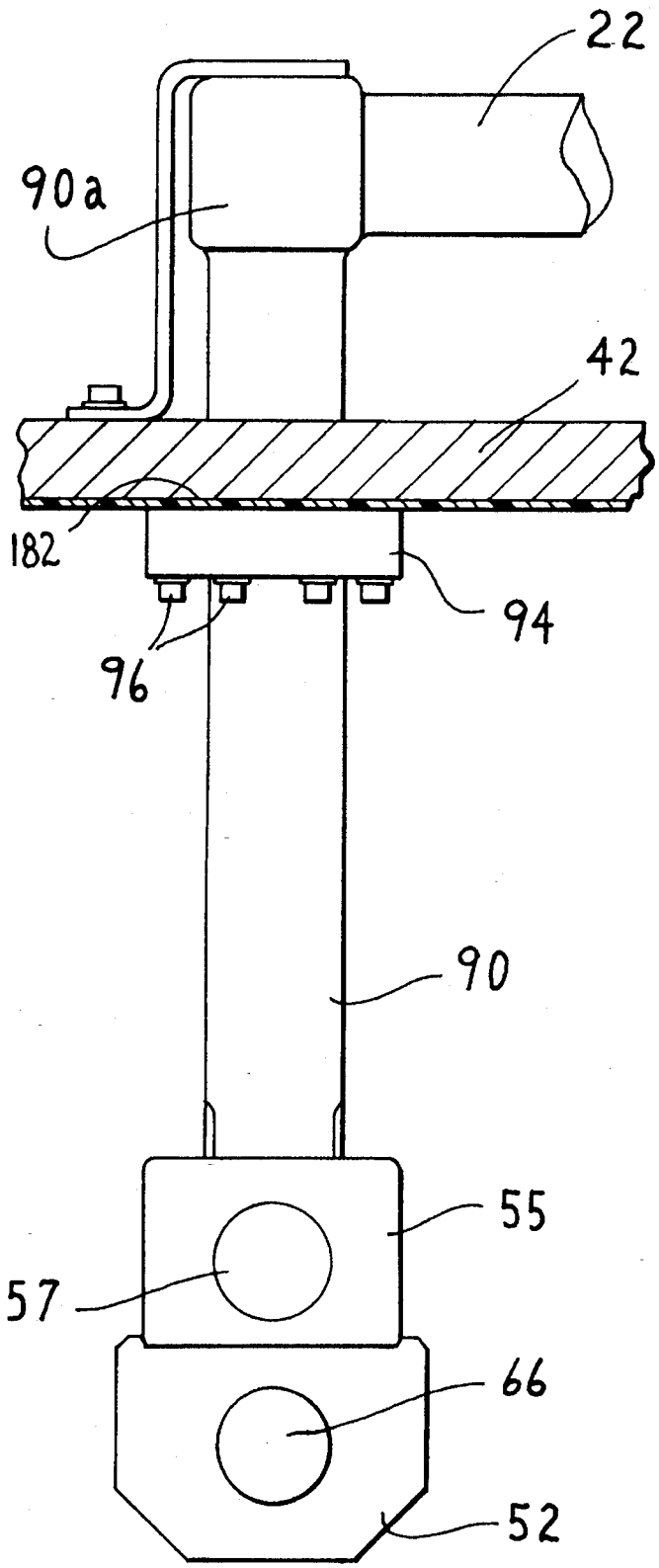
FIG. 4 is a side view of certain melt outlet components of the melt pumping apparatus of FIG. 2 taken in the direction of arrows 4—4 with the upper support frame not shown for clarity.

Referring to FIGS. 2–4, melt pumping apparatus 30 in accordance with one embodiment of the invention is shown. The melt supply apparatus 30 comprises support means 40, such as a plate-like support member 42 disposed on the upper surface 20*a* of the furnace vessel 20 (FIG. 1). Suspended from the underside of the support member 40 are melt pump casing or housing means 44, piston means 46, and melt inlet and outlet valve means 48, 50 that constitute melt pumping components for pumping the melt M in controlled amounts from the furnace 20 to the die casting machine 13. The casing or housing means 44, piston means 46, and melt inlet and outlet valve means 48, 50 are suspended in such a manner that lower portions thereof are submerged in the melt M (i.e. below the melt upper level L) in the furnace vessel 20 as shown best in FIGS. 1–2. As a result, at least the lower portions of the casing means 44, piston means 46, and melt inlet and outlet valve means 48, 50 comprise a ceramic material that is resistant to attack by the highly corrosive melt M at the pumping pressures, submersion times and other service conditions to be encountered by the melt supply apparatus 30. For example, in die casting successive charges of aluminum melt using the casting apparatus 10 shown in FIG. 1, the ceramic material should be dimensionally stable, non-wetted by molten aluminum, and capable of operating without substantial corrosion/deterioration at melt temperatures of 1250°–1350° F. and melt pumping pressures of 20 psi for extended time periods corresponding to, for example, 100,000 die cast cycles (i.e. 100,000 charges of melt). Silicon nitride material available commercially as silicon nitride ($Si_3N_4$) KN-101 material from Kubota Corporation of North America, New York, N.Y., can be used in the fabrication of casing means 44, piston means 46, and melt inlet and outlet valve means 48, 50 and conduit 22 and is capable of providing such performance in the die casting of aluminum melts. Other ceramic materials that can be used to fabricate the submersible pump components described above for pumping aluminum melts include boron nitride (BN), silicon nitride ($Si_3N_4$)-boron nitride (BN) composite, titanium boride ($TiB_2$) and the like.

Although in FIG. 2, the casing means 44, piston means 46, and melt inlet and outlet valve means 48, 50 are fabricated as monolithic bodies of the ceramic material, the invention is not so limited. For example, the lower portions of the casing means 44, piston means 46, and melt inlet and outlet valve means 48, 50 submerged in the melt M can be made of melt-resistant ceramic material while upper portions thereof above the melt level L can be made of other materials, such as suitable heat resistant metals or alloys. Furthermore, the lower portions of the casing means 44, piston means 46, and melt inlet and outlet valve means 48, 50 submerged in the melt M can comprise a metal or alloy material coated with a suitable melt-resistant ceramic material (e.g. silicon nitride for an aluminum melt) resistant to attack by the melt M under the service conditions to be encountered by the melt supply apparatus 30. The lower portions of the casing means 44, piston means 46, and melt inlet and outlet valve means 48, 50 submerged in the melt M can be fabricated from the same or different ceramic or ceramic coating material so long as the material is resistant to attack by the melt M under the service conditions to be encountered by the melt supply apparatus 30.

For purposes of illustration only, the casing means 44 is shown comprising a ceramic melt inlet casing 52 having an upstanding ceramic casing sleeve 54 and a ceramic melt outlet casing 55. The melt inlet casing 52 includes an elongated melt pumping chamber 60 having a melt inlet 62 proximate one end and a melt outlet 64 proximate another end. Opposite open ends 60*a*, 60*b* of the chamber 60 are closed off by respective ceramic plugs 66, 68 sealed and bonded therein. The plugs 66, 68 are bonded to the melt inlet casing 52 by a glass powder bonding technique wherein glass powders are placed between the plugs 66, 68 and the inlet casing 52 and heated to melt the powders so as to form a diffusion bond therebetween that can withstand the temperature of the melt M.

The ceramic casing sleeve 54 includes a bore 72 for receiving the piston means 46. The piston sleeve 54 includes a lowermost end 54*a* received in an opening 52*a* of the melt inlet casing 52. The lower end 54*a* can be screw threaded and/or bonded by the aforementioned glass powder bonding technique in the opening 52*a* to provide a sealed connection therebetween.

The casing sleeve 54 is supported proximate its upper end from the underside of the support member 40. In particular, a peripheral rib 54*b* of the sleeve is clamped between a metallic (e.g. INCONEL 750) flange or collar 80 that is fastened by screws 82 to a metallic (INCONEL 750) flange or collar 84. Flange or collar 84 is fastened by screws 86 to the support member 40 in the manner shown best in FIG. 2. Collars 80, 84 are located above the melt level L with collar 84 residing in a suitable opening in the support member 40. The melt inlet casing 52 and lower portion of the piston sleeve 54 are thereby suspended below the melt level L in the vessel 20. Preferably, the melt inlet 62 of the melt inlet casing 52 is positioned at a location or submerged level in the melt M where there is the lowest content of oxide and other inclusions so that the cleanest melt M is pumped by the melt supply apparatus 30 to the die casting machine 13. For an aluminum melt M, some inclusions tend to float on the surface of the melt while other types of inclusions tend to sink to the bottom of the melt. Thus, the desired location for the melt inlet 62 will correspond to an intermediate depth of the melt M in the vessel 20.

A metallic (e.g. Type 304 stainless steel) gasket 88 is disposed between the collars 80, 84. Thermal insulating packing 89 is disposed between the collar 84 and the support member 40.

The casing or housing means 44 also comprises a ceramic melt outlet casing 55 disposed on the melt inlet casing 52. In particular, the melt outlet casing 55 is adhered by the aforementioned glass powder bonding technique in a recess 52*c* formed on the melt inlet casing 52. The melt outlet casing 55 includes a melt discharge passage 55*a* communicated to the melt outlet 64 of the melt inlet casing 52 as shown best in FIG. 2. A ceramic plug 57 is sealed and adhered by the aforementioned glass powder bonding technique in the open end of the outlet casing 55 to close off the end of the passage 55*a*.

A two-piece ceramic casing discharge sleeve 90 is disposed on the melt outlet casing 55 and includes a lower sleeve end 92 screw threaded and/or adhered by the aforementioned glass powder bonding technique in the casing opening 55*b* to provide a sealed connection therebetween. The discharge sleeve 90 is fastened to the underside of the support member 40 by a flange or collar 94 by screws 96. A metallic (e.g. Type 304 stainless steel) gasket 98 is disposed between the collar 94 and shoulder of the outlet sleeve 90. Thermal insulating packing 100 is disposed between the support member 40 and the shoulder of the discharge sleeve 90.

The casing discharge sleeve 90 extends above the support member 42 through a suitable opening therein and terminates in a discharge end 90*a* that is connected to the supply conduit 22 for supplying the melt M thereto in controlled amounts for introduction into the shot sleeve 14 of the die casting machine 13 (FIGS. 1 and 4).

Ceramic piston means 46 is received in the bore 72 of the casing sleeve 54 as shown best in FIG. 2. The piston means comprises a lower elongated, piston pumping portion 110 submerged below the melt level L and received in the bore 72 for movement relative to chamber 60 between a first position P1 (see phantom line position in FIG. 2) where the piston pumping portion 110 is at the end of the suction stroke and a second lower position P2 (see solid line position) where the piston pumping portion 110 is at the end of the pumping stroke. The suction/pumping stroke of the piston pumping portion 110 is adjustable by the computer processing unit CPU shown in FIG. 1 as explained herebelow.

The piston pumping portion 110 is received with close tolerance fit in the piston sleeve bore 72 to prevent blow-by of the melt M during the suction/pumping strokes and includes annular relieved regions 112 to reduce friction between the piston portion 110 and the casing sleeve 54. For purposes of illustration only, in pumping an aluminum melt using a silicon nitride piston means 46, the outer piston diameter can be 105 mm (millimeters) −0.012 to −0.034 mm. A silicon nitride piston sleeve 54 receiving the piston will have an inner diameter of 105 mm 0 to +0.040 mm whereby melt blow-by is prevented during the suction/pumping strokes at a melt pumping pressure of 20 psi.

The piston means 46 includes a tapering actuated shank portion 114 that extends upwardly from the pumping portion 110 above the melt M where the shank portion terminates in a knob portion 116. The knob portion 116 is clamped between a piston holder 118 and a piston flange 119 fastened together by screws 120. The piston holder and flange are made of chromium molybdenum steel. A thermal insulating plate 121 is disposed between the holder 118 and flange 120 as shown best in FIG. 2 to provide a thermal break between the knob 116 and the flange 119.

The flange 119 is threaded to a floating joint 122 connected to a shaft 123 and coupling 125 extending to an adjustable stroke actuator 124. The actuator 124 is disposed atop a support frame 130 that is fastened on the support member 40 (together constituting support means) above the melt M by peripheral screws 132 (see also FIG. 3). The adjustable stroke actuator 124 can comprise a fluid (e.g. air or oil) actuator or an electrical actuator. The suction/pumping strokes of the piston pumping portion 110 as well as the stroke timing are controlled by a computer processing unit CPU (FIG. 1) to provide the desired pumping action of melt to the die casting machine 13; i.e. a predetermined amount or weight of melt M is pumped into the shot sleeve 14 in periodic manner corresponding to the casting cycle of the die casting machine 13. An exemplary hydraulic actuator 124 for use in practicing the invention is available as model 10A2R-RFA100B125 from Taiyo Ltd., Japan and is controlled by a conventional computer processing unit CPU to provide a predetermined piston stroke and stroke timing for the die casting machine 13.

Referring to FIG. 2, ceramic melt inlet and outlet valve means 48, 50 are operably associated with the ceramic melt inlet casing 52 to control flow of melt M into and out of the melt pumping chamber 60. The melt inlet valve means 48 includes a valve portion 48*a* submerged in the melt and movable relative to the melt inlet 62 to open/close the melt inlet 62 when the piston means 46 is moved in the respective suction/pumping stroke. The melt outlet valve means 50 includes a valve portion 50*a* submerged in the melt and movable relative to the melt outlet 64 to close/open the melt outlet 64 when the piston pumping portion 110 is moved in the respective suction/pumping stroke.

The melt inlet valve means 48 includes an upper actuated end portion 48*b* extending above the melt level L and connected to a connector body 144 by pin 145 (both INCONEL 750). The connector body 144/pin 145 are connected to a floating joint 146 to which the shaft 148 of a fixed stroke actuator 150 is connected. The actuator 150 is supported on the support frame 130 proximate the adjustable stroke actuator 124. The melt outlet valve means 50 includes a like upper end portion 50*b* operably connected by a like connector body 144 by pin 145 and floating joint 146 to the shaft 148 of another fixed stroke actuator 150 supported on the support frame 130. In this way, the melt inlet and outlet valve means 48, 50 are moved relative to the respective melt inlet and outlet 62, 64. The fixed stroke actuators 150 can comprise a fluid (e.g. air or oil) actuator or an electrical actuator.

The actuators 150 are controlled by the aforementioned computer processing unit CPU to provide the desired opening/closing of the melt inlet 62 and closing/opening of the melt outlet 64 as described hereabove in dependence on the stroke of the piston pumping portion 110. An exemplary fixed stroke air actuator 150 for use in practicing the invention is available as model 10A2R-RFA80B100 from Taiyo Ltd., Japan.

The actuators 124 and 150 are shielded from the heat of the underlying melt M by thermal insulating plate 180 on the support member 40 as shown best in FIG. 2.

A thermal insulating plate 182 is disposed on the underside support member 42 to the same end.

The actuator 124 for the piston means 46 and the actuators 150 for the melt inlet and outlet valve means 48, 50 also are controlled by the CPU to supply a predetermined amount or weight of melt M (i.e. a predetermined charge of melt M) into the shot sleeve 14 in periodic manner corresponding to the casting cycle of the die casting machine 13. The CPU can be interfaced to a computer process unit (not shown) of the casting machine 13 to this end. In operation of the casting apparatus 10, the supply conduit 22 initially is filled fully with the melt M by the melt pumping apparatus 30 as controlled by the CPU. Then, during operation of the die casting machine 13, the melt pumping apparatus 30 can be controlled by the CPU to pump successive charges of the melt M into the supply conduit 22 and thus displace an equivalent charge of melt M from the conduit 22 into shot sleeve 14 at periodic intervals corresponding to the casting cycle of the die casting machine 13.

To this end, the melt pumping apparatus 30 is controlled such that the piston means 46 is positioned at the upper position P1 with inlet valve means 48 and outlet valve means 50 open and closed relative to the respective melt inlet 62 and melt outlet 64 of the melt pumping chamber 60. This fills the melt pumping chamber 60 with the melt M. Then, the inlet valve means 48 is closed relative to the melt inlet 62, while the outlet valve means 50 is opened relative to melt outlet 64. The piston means 46 is moved from position P1 to position P2 to pump the melt M from the chamber 60 through the melt outlet 64 and outlet sleeve 90 to the conduit 22. Thereafter, the outlet valve means 50 is closed relative to the melt outlet 64, while the melt inlet valve means 48 is opened relative to the melt inlet 62. As the piston means 46 is moved from position P2 to position P1, the melt M is drawn into the melt pumping chamber 60 from the vessel 20. This sequence is repeated to pump successive charges of the melt M to the conduit 22 and hence to the shot sleeve 14.

In an alternative mode of operation, the casting apparatus 10 can be operated in a drain back mode wherein the supply conduit 22 does not remain full of the melt M during operation of the die casting machine 13 and instead is allowed to drain back to the furnace vessel 20 after each charge of melt M is introduced to the shot sleeve 14. The actuators 124 and 150 can be controlled by the CPU to this end. For example, after the actuator 124 moves the piston pumping portion to the position P2 to introduce a charge of the melt M into the shot sleeve 14, actuators 150 will be controlled to reopen the melt inlet valve means 48 and leave the melt outlet valve means 50 open for a period of time sufficient to allow the melt in the supply conduit 22 to drain back through the chamber 60 into the furnace vessel 20. The next charge of melt M is introduced to the shot sleeve 14 by CPU control of the melt pumping apparatus 30 to pump melt M through the supply conduit 22 until the predetermined charge is supplied to the shot sleeve 14. Then, the melt pumping apparatus 30 is controlled by the CPU in the manner described hereabove to allow the melt in the conduit 22 to drain back into the furnace vessel 20.

The melt pumping apparatus 30 is advantageous when used in conjunction with a melt casting machine 12, such as the die casting machine 13 described hereabove, to provide controlled, predetermined amounts or charges of the melt M with reduced melt transport time. Since the melt M is confined in the furnace vessel 20 and the ceramic supply conduit 22 at all times prior to delivery to the casting machine 12, the temperature of the melt M does not drop as rapidly as in the ladle technique employed heretofore. As a result, the temperature of the melt M in the furnace vessel 20 can be reduced, if desired. A reduced melt temperature in the furnace vessel 20 will result in reduced thermal shock to the die casting machine components, especially the die members 16, 18. As explained hereabove, the cleanest (most inclusion free) melt M is pumped by the melt pumping apparatus 30 from the furnace vessel 20 to the casting machine 12. Moreover, the melt M is not exposed to ambient air during transport to the casting machine 12 to the extent that it is in the ladle transport technique used heretofore. As a result, the melt M supplied to the casting machine 12 will be cleaner (freer of inclusions, dross and sludge) so as to yield higher quality castings.

While the invention has been described in terms of specific embodiments thereof, it is not intended to be limited thereto but rather only to the extent set forth in the following claims. For example, the material to be used for the outlet valve means and the casing discharge sleeve is not limited to ceramic but alternately can comprise cermet, intermetallic compound or the like.

The embodiments of the invention in which an exclusive property or privilege is claimed are defined as follows:

1. Melt pumping apparatus, comprising pump casing means including a melt pumping chamber submersible in the melt and having a melt inlet and melt outlet communicated to said chamber and a piston-receiving bore communicated to said chamber, piston means disposed in said bore and having a piston pumping portion submersible in the melt and movable relative to said chamber in a suction stroke to draw the melt into said chamber through said melt inlet and in a pumping stroke to discharge the melt from said chamber through said melt outlet, actuator means for moving said piston means to move said piston pumping portion relative to said chamber, melt inlet valve means having a valve portion submersible in the melt and movable relative to said melt inlet to open/close said melt inlet when said piston pumping portion is moved in the respective suction/pumping stroke, actuator means for moving said melt inlet valve means relative to said melt inlet in synchronism with said piston pumping portion to open/close said melt inlet when said piston pumping portion is moved in the respective suction/pumping stroke, melt outlet valve means having a valve portion submersible in the melt and movable relative to said melt outlet to close/open said melt outlet when said piston pumping portion is moved in the respective suction/pumping stroke, and actuator means for moving said melt outlet valve means relative to said melt outlet in synchronism with said piston pumping portion to close/open said melt outlet when said piston pumping portion is moved in the respective suction/pumping stroke.

2. The apparatus of claim 1 further comprising support means for positioning on a melt-holding vessel, said casing means, piston means, and melt inlet and outlet valve means being supported on said support means such that said melt-pumping chamber, said piston pumping portion, and said melt inlet and outlet valve portions are submerged in the melt.

3. The apparatus of claim 2 wherein submerged portions of said casing means, said piston means, and said melt inlet and outlet valve means comprise the same or different ceramic material that is resistant to attack by said melt.

4. The apparatus of claim 3 wherein the ceramic material comprises silicon nitride for pumping aluminum melt.

5. The apparatus of claim 3 wherein said casing means is suspended from said support means in a manner to position said melt inlet at a location in the melt where the melt has the lowest inclusion content.

6. The apparatus of claim 5 wherein said means for moving said piston means, said means for moving said melt inlet valve means, and said means for moving said melt outlet valve means are supported on said support means above the melt.

7. The apparatus of claim 5 wherein said casing means comprises a melt inlet casing and a casing sleeve fastened thereon and defining said piston-receiving bore therein, said casing sleeve being supported beneath said support means to position said melt inlet casing submerged in the melt.

8. The apparatus of claim 7 wherein said casing means further comprises a melt outlet casing having a melt discharge passage communicated to said melt outlet and a casing sleeve fastened on said melt outlet casing and supported from said support means so as to position said melt outlet casing submerged in the melt.

9. Apparatus for pumping melt from a melt-holding vessel, comprising support means for positioning on the melt-holding vessel, pump casing means including a melt pumping chamber having a melt inlet and melt outlet communicated to said chamber and a piston-receiving bore communicated to said chamber, said casing means being supported on said support means in a manner that said melt-pumping chamber is submerged in the melt, piston means disposed in said bore, said piston means having a piston pumping portion submerged in the melt and movable relative to said chamber in a suction stroke to draw the melt into said chamber through said melt inlet and in a pumping stroke to discharge the melt from said chamber through said melt outlet, actuator means disposed on said support means for moving said piston means to move said piston pumping portion relative to said chamber, melt inlet valve means having a valve portion submersible in the melt and movable relative to said melt inlet to open/close said melt inlet when said piston pumping portion is moved in the respective suction/pumping stroke, actuator means disposed on said support means above the melt for moving said melt inlet valve means relative to said melt inlet in synchronism with said piston pumping portion to open/close said melt inlet when said piston pumping portion is moved in the respective suction/pumping stroke, melt outlet valve means having a valve portion submersible in the melt and movable relative to said melt outlet to close/open said melt outlet when said piston pumping portion is moved in the respective suction/pumping stroke, and actuator means disposed on said support means above the melt for moving said melt outlet valve means relative to said melt outlet in synchronism with said piston pumping portion to close/open said melt oulet when said piston pumping portion is moved in the respective suction/pumping stroke.

10. The apparatus of claim 9 wherein said casing means comprises a melt inlet casing having a casing sleeve fastened thereon and defining said piston-receiving bore therein, said casing sleeve being supported beneath said support means to position said melt inlet casing submerged in the melt.

11. The apparatus of claim 10 said casing means further comprises a melt outlet casing having a melt discharge passage communicated to said melt outlet and a casing sleeve fastened on said outlet casing and supported from said support means to position said outlet casing submerged in the melt.

12. The apparatus of claim 11 wherein said melt outlet casing is disposed on said melt inlet casing.

13. Apparatus for supplying an aluminum melt from a melt-holding vessel to a melt casting machine, comprising support means for positioning on the melt-holding vessel, pump casing means including a ceramic melt pumping chamber with a melt inlet and melt outlet communicated to said chamber and having a piston-receiving bore communicated to said chamber, said casing means being supported on said support means in a manner that said pumping chamber is submerged in the melt, piston means disposed in said bore, said piston means having a ceramic piston pumping portion submerged in the melt and movable relative to said chamber in a suction stroke to draw the melt into said chamber through said melt inlet and in a pumping stroke to discharge the melt from said chamber through said melt outlet, actuator means disposed on said support means for moving said piston means to move said piston pumping portion relative to said chamber, a melt inlet valve means having a ceramic valve portion submerged in the melt and movable relative to said melt inlet to open/close said melt inlet when said piston pumping portion is moved in the respective suction/pumping stroke, actuator means disposed on said support means above the melt for moving said melt inlet valve means relative to said melt inlet, a melt outlet valve means having a ceramic valve portion submerged in the melt and movable relative to said melt outlet to close/open said melt outlet when said piston pumping portion is moved in the respective suction/pumping stroke, and actuator means disposed on said support member above the melt for moving said melt outlet valve means relative to said melt inlet.

14. The apparatus of claim 13 wherein the ceramic pumping chamber, ceramic piston pumping portion and ceramic valve portions comprise silicon nitride.

15. Melt casting apparatus comprising a melt casting machine, a melt-holding vessel, a melt pumping apparatus as set forth in claim 13 operably associated with said vessel for pumping the melt from said melt-holding vessel to said melt casting machine, and a melt supply conduit connecting said melt casting machine and said melt pumping apparatus in melt flow communication.

16. Melt casting apparatus comprising a melt casting machine, a melt-holding vessel, a melt pumping apparatus as set forth in claim 1 operably associated with said vessel for pumping the melt from said melt-holding vessel to said melt casting machine, and a melt supply conduit connecting said melt casting machine and said melt pumping apparatus in melt flow communication.

17. Melt pumping apparatus, comprising pump casing means including a melt pumping chamber submersible in the melt and having a melt inlet and melt outlet communicated to said chamber and a piston-receiving bore communicated to said chamber, piston means disposed in said bore and having a piston pumping portion submersible in the melt and movable relative to said chamber in a suction stroke to draw the melt into said chamber through said melt inlet and in a pumping stroke to discharge the melt from said chamber through said melt outlet, piston actuator means for moving said piston means to move said piston pumping portion relative to said chamber in the respective suction/pumping stroke, melt inlet valve means having a valve portion submersible in the melt and movable relative to said melt inlet to open/close said melt inlet when said piston pumping portion is moved in the respective suction/pumping stroke, melt inlet valve actuator means for moving said melt inlet valve means relative to said melt inlet, melt outlet valve means having a valve portion submersible in the melt and movable relative to said melt outlet to close/open said melt outlet when said piston pumping portion is moved in the respective suction/pumping stroke, and actuator means for moving said melt outlet valve means relative to said melt outlet, and computer control means for controlling said piston actuator means, said melt inlet valve actuator means, and said melt outlet valve actuator means to synchronize opening and closing of said melt inlet and said melt outlet in dependence on movement of said piston pumping portion to pump successive charges of melt from said chamber.

* * * * *